US005671688A

United States Patent [19]

Bürgin et al.

[11] Patent Number: 5,671,688

[45] Date of Patent: Sep. 30, 1997

[54] PROCESS FOR TREATING SLAG FROM REFUSE INCINERATION PLANTS

[75] Inventors: Markus Bürgin, Rieden; Bruno Carcer, Aarau; Alfred Edlinger, Zürich; Jean-Marc Martelli, Dübendorf, all of Switzerland

[73] Assignee: Asea Brown Boveri AG, Baden, Switzerland

[21] Appl. No.: 568,837

[22] Filed: Dec. 7, 1995

[30] Foreign Application Priority Data

Jan. 21, 1995 [DE] Germany ..... 195 01 830.3
Mar. 9, 1995 [DE] Germany ..... 195 08 293.1

[51] Int. Cl.[6] ..... F23J 3/00

[52] U.S. Cl. ..... 110/344; 241/19; 210/695

[58] Field of Search ..... 110/344, 345, 110/346, 235, 255, 259; 241/19, 21, 24.12, 24.13, 24.14, 24.15, 29, DIG. 38; 210/695, 772

[56] References Cited

U.S. PATENT DOCUMENTS 5,051,190 9/1991 Schwyter ..... 210/695
5,143,304 9/1992 Schwyter ..... 241/19
5,356,082 10/1994 Prinz et al. ..... 241/24

FOREIGN PATENT DOCUMENTS 0437679 7/1991 European Pat. Off. .
0372039 8/1992 European Pat. Off. .

*Primary Examiner*—Henry A. Bennett
*Assistant Examiner*—Pamela A. O'Connor
*Attorney, Agent, or Firm*—Oblon, Spivak, McClelland, Maier & Neustadt, P.C.

[57] ABSTRACT

In the process for treating slag from refuse incineration plants, the crude slag, after passing through the firing grate, is separated into at least two fractions directly and without previous quenching in a water bath. These two fractions are further processed separately, the coarse fraction being fed to a wet deslagger. For optimum separation of the two fractions, the first fraction, having a particle size preferably up to 32 mm, is separated off in a first screening stage and the screen oversize of the first screening stage is fed to the wet deslagging. The screen undersize and if appropriate the material passing through the firing grate are fed to a second screening stage to separate off the fine fraction 0 . . . 2 mm. The screen oversize of the second screening stage, if appropriate after removing metallic and inert materials, is mechanically comminuted. In an optional third screening stage (8), the fine fraction 0 . . . 2 mm is fed together with the screen undersize of the second screening stage to a special treatment.

24 Claims, 3 Drawing Sheets

PROCESS FOR TREATING SLAG FROM REFUSE INCINERATION PLANTS

BACKGROUND OF THE INVENTION

1. Field of the Invention

The invention relates to a process for treating slag from refuse incineration plants in which the crude slag, after passing through the firing grate, is separated into at least two fractions directly and without previous quenching in a water bath and these two fractions are further processed separately, the coarse fraction being fed to a wet deslagger.

Such a treatment process is disclosed, for example, by EP-0 437 679 B1.

2. Discussion of Background

In the incineration of residential waste, about 250 kg of slag result as residue per ton of refuse. The resulting slag, directly downstream of the furnace, has contents of pollutants which prevent its further use, e.g. as a building material. Deposition of the slag in landfills poses a threat to the environment unless special precautions are taken, e.g. collecting the lechate water.

Usually, the slag is quenched in a wet deslagger directly downstream of the furnace outlet. Without additional washing of the slag, the heavy metal content in the slag cannot be decreased in this process and considerable contents of toxic substances remain in the slag.

EP-0 437 679 discloses a process for treating residues of a refuse incineration plant, in which the crude slag, after passing through the firing grate, is separated into two fractions, the grate slag, with the boiler ash and the material which passes through the grate being separated into two fractions. The fraction having components whose diameter is smaller than 100 to 300 mm is melted in a separated melting furnace, and the larger components of the grate ash and boiler ash are introduced into a wet deslagger.

This comparatively coarse classification ultimately leads to the fact that components are fed to the melting furnace which do not actually require such a special treatment.

In EP Patent 0 372 039, a route is now shown for the first time for treating slag from garbage and waste incineration furnaces. The slag is fed downstream of the furnace, directly and without previous quenching in a water bath, for the coarse cleaning (removal of unburnt coarse material and magnetic components). The coarsely cleaned slag is then separated into at least two fractions and all particles which are smaller than 2 mm are allocated to one fraction.

The finding underlying this known process is that the fine fraction contains the largest part of the pollutants originally contained in the slag at slag outflow. The fine fraction is fed for a special treatment. The coarse fraction, in contrast, is suitable for direct use as building material or for deposition in landfills.

In the industrial implementation of the process according to EP Patent 0 372 039 certain technical difficulties are posed, on the one hand separating off the fine fraction up to 2 mm—conventional mesh conveyors or other classifying devices have a tendency to become blocked, on the other hand air exclusion from the combustion compartment must be ensured and cooling the coarse fraction is also problematic.

SUMMARY OF THE INVENTION

Accordingly, one object of the invention is to provide a novel process of the generic type mentioned at the outset which enables simple separation off of the fine portion, exclusion of air from the combustion compartment and cooling of the second fraction can be achieved by simple means.

The concept underlying the invention is to separate off the polluted fine fraction in a "dry" route and to further process the low-pollutant coarse fraction by the "wet" method. This procedure—it could be called "semidry deslagging" in keywords—offers, in combination with the two-stage production of the up to 2 mm fine fraction, numerous advantages:

- simple separation of the fine fraction by conventional classification devices
- exclusion of air from the combustion compartment which is simple to carry out, more precisely for the two particles streams, in particular the wet deslagging of the coarse fraction around 30 mm being able to be carried out using proven technology.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
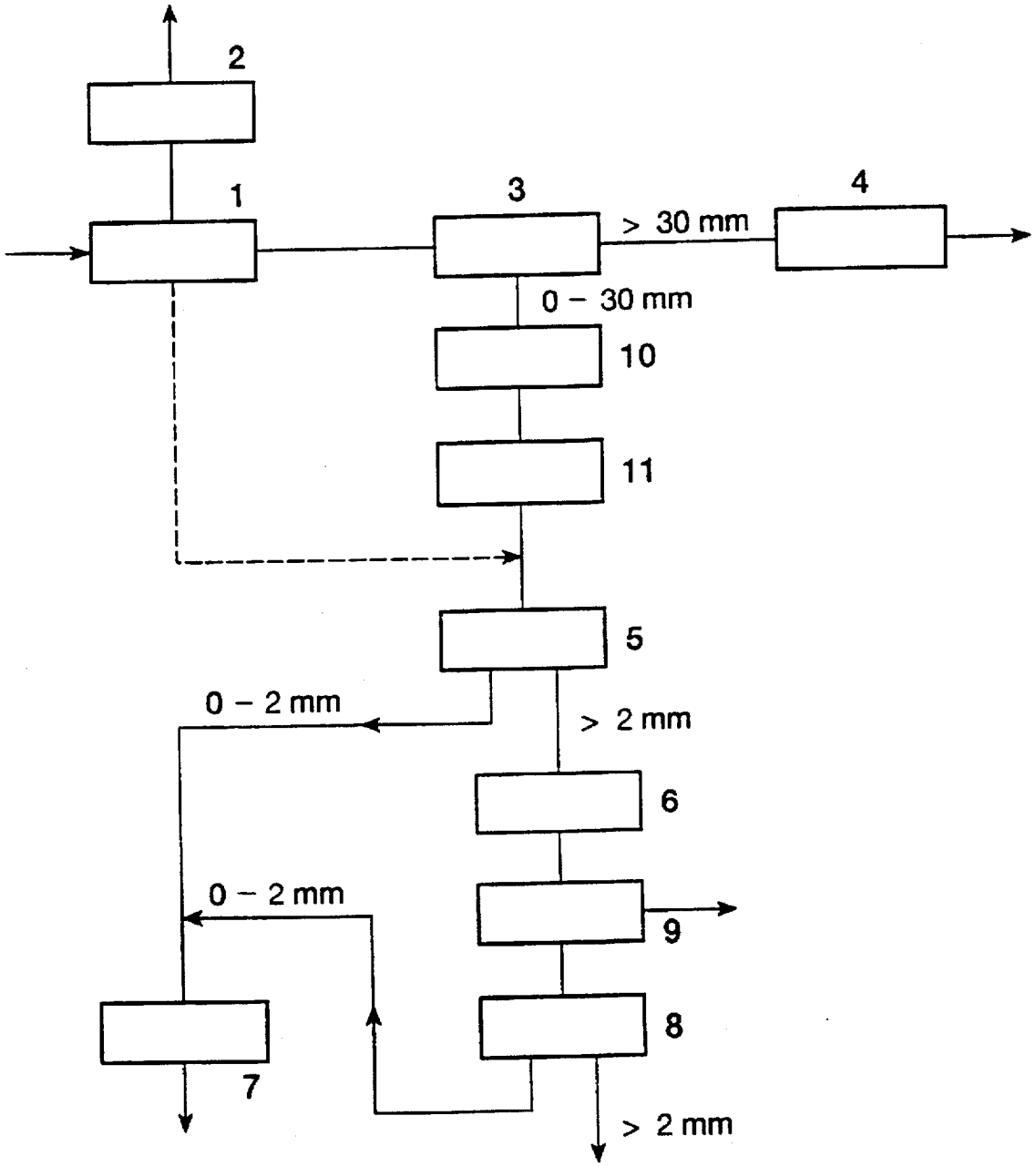
FIG. 1 shows a plant composed of individual components for treatment of slag from refuse incineration plants.

Referring now to the drawings, wherein like reference numerals designate identical or corresponding parts throughout the several views, in FIG. 1 refuse is incinerated in an incineration furnace 1. The flue gases formed in this and entrained particles (fly ash as boiler ash and filter ash) are treated in a known manner in a separator and filter stage 2 as described and depicted by way of example in EP-0 437 679 B1. The grate ash passes directly from the furnace grate to a first screen stage 3. This is preferably constructed as a mesh travelling grate. Such devices are known and, in addition to other areas of use, are also used in garbage incineration plants for screening out the fine fraction (cf. the brochure "Jost Siebförderroste [Jost Mesh Travelling Grates]" of Jost AG Maschinenfabrik, CH-3627 Heimberg, FOT 1.92 –3000, undated). In this first screening stage, the crude slag is divided into a fine fraction having particle diameters up to 80 mm, and preferably less than 25–35 mm and a corresponding coarse fraction. The coarse fraction passes as screen oversize into a wet deslagger 4 of known type. This simultaneously ensures exclusion of air on the coarse fraction side firm the furnace interior.

The fine fraction below 25–35 mm is fed to a second screening stage, e.g. a tension shaft screen or preferably a vibratory screen likewise of known type. Optionally, the material passing through the grate from the incineration furnace 1 can also be fed to the second screening stage 5, which is symbolized in the figure by a dashed line. The screen undersize of the second screening stage 5 having particles of up to 2 mm is given a special or further treatment, e.g., the under size is melted in a melting furnace 7. The screen oversize of the second screening stage 5 is mechanically comminuted in a grinding stage 6, e.g. in a ball mill. In the case of the example, the ground material is again separated in a third (optional) screening stage 8, e.g. a bar screen, into two fractions, that is a fine fraction having .particle size sizes of up to 2 mm and a coarse fraction greater than 2 mm. The fine fraction (which in comparison to the fine fraction up to 2 mm of the second screening stage 5, contains less pollutants) is likewise fed to the melting furnace 7. The coarse fraction (which essentially only comprises inert materials) can be landfilled. In some circumstances, between the grinding stage 6 and the third screening stage 8 there can be provided a classifying stage 9 in order to separate out metal pieces as early as here, preferably separately according to ferrous and non ferrous metals and other inert substances.

The still very hot screen undersize from the first screening stage 3 is usually transported to the second screening stage 5 by conveying devices known per se. Preferably, a further development of the invention envisages providing here a discharge means, preferably a screw conveyor 10, which unites the cooling and air exclusion functions. This screw conveyor 10 simultaneously serves as air-exclusion means on the fine fraction side of the first screening stage 3 with respect to the incineration furnace 1 but also acts as cooling apparatus for ash cooling, since in a screw conveyor, owing to its construction, the material to be conveyed comes into contact with the conveyor screws over a large surface area and the material to be conveyed can be cooled simply. If the screw conveyor 10 should prove to be insufficiently effective in its function as air exclusion means, downstream of this there can be connected a double flap valve 11, also called a two-bladed shutoff valve in the literature.

Figure 2:
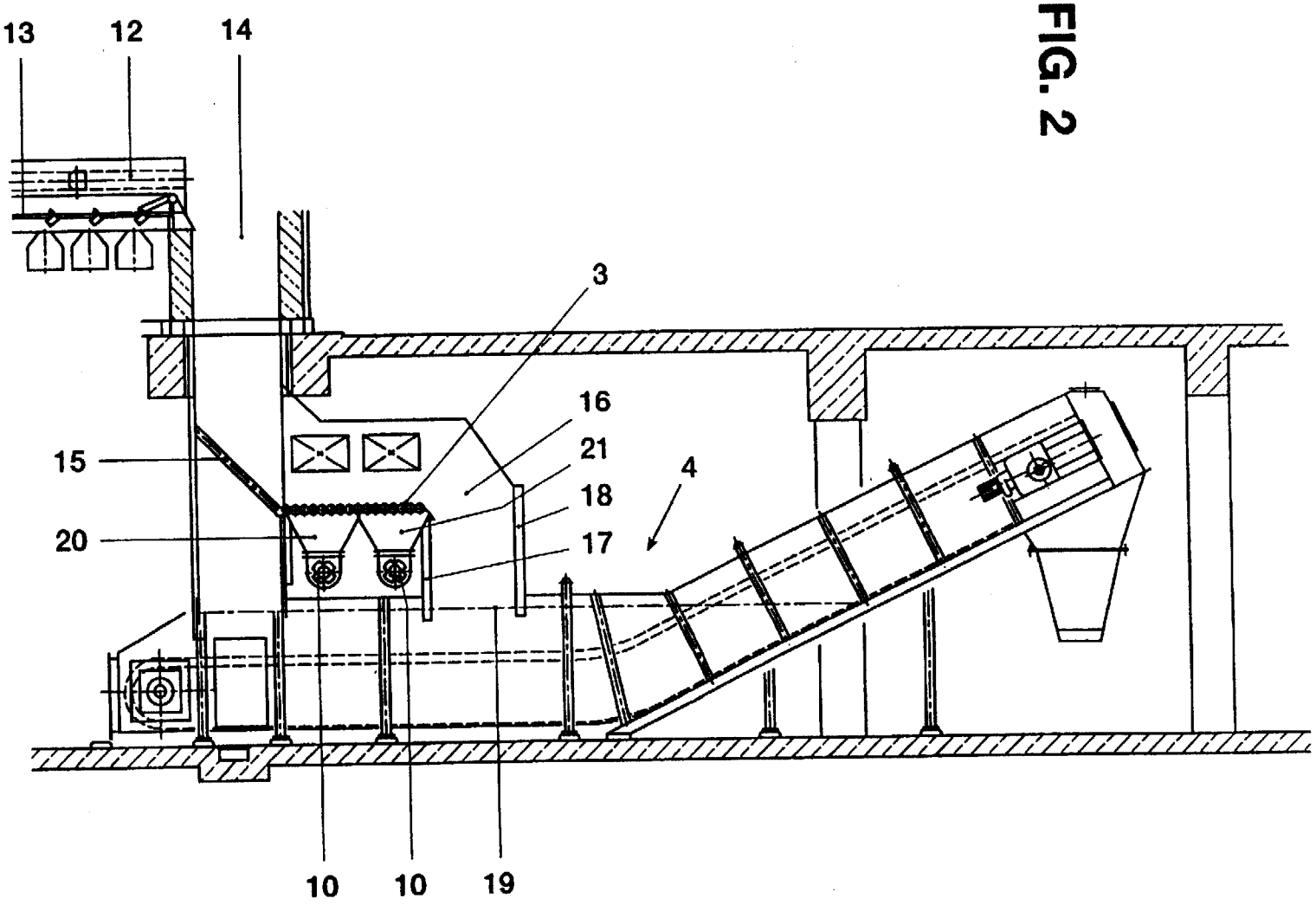
FIG. 2 shows a simplified longitudinal section through part of a refuse incineration plant.
Figure 3:
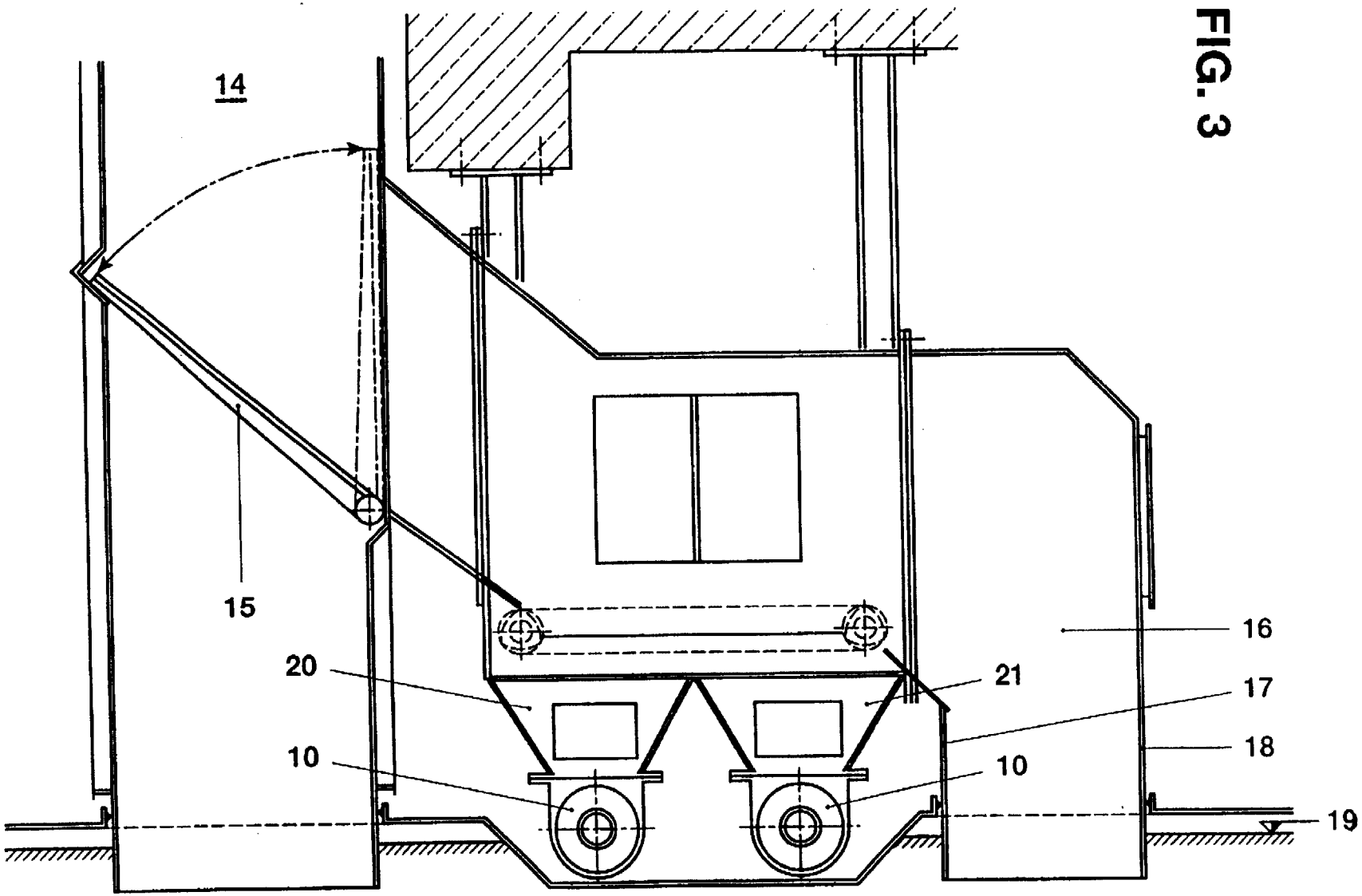
FIG. 3 shows a more detailed section through the first screening stage of the plant according to FIG. 2.

As can be seen from FIGS. 2 and 3, the "semi dry process" described may be integrated into a refuse incineration plant without great expenditure. In these two figures, only those components are shown which relate to the core of the invention, that is separating off the first fraction having a particle size around 30 mm in the first screening stage and wet deslagging of the screen oversize of this screening stage.

Burnt slag 12 (coarse/fine), at the end of the grate 13, falls into a slag shaft 14, the walls of which extend downwards until they are immersed in the wet deslagger 4. In the side wall of the slag shaft, there is arranged a deflection flap 15 so as to be able to pivot. Usually, this deflection flap 15 is pivoted out of its vertical position and closes the direct access to the wet deslagger 4. Burnt slag is then fed directly to the first screening stage 3 which is preferably designed as a mesh travelling grate. The screen oversize of the first screening stage 3 passes directly into the wet deslagger 4 beneath the screening stage 3. The arrangement is made in such a way here that the screen oversize falls into a shaft 16 whose walls 17, 18 extend downwards to the extent that they end below the water level 19. In this manner, air is excluded from the slag shaft 14 and thus the furnace interior.

The screen undersize is collected in one or more hoppers 20, 21 below the first screening stage 3 and is discharged separately and dry via suitable discharge apparatuses 10, e.g. screw conveyors or drag flight conveyors and is further treated as described in connection with FIG. 1. In the case of a breakdown in the first screening stage 3, the deflection flap 15 can be set vertically (drawn dashed in FIG. 3 ), so that all of the slag can be discharged conventionally (wet).

Obviously, numerous modifications and variations of the present invention are possible in light of the above teachings. It is therefore to be understood that within the scope of the appended claims, the invention may be practised otherwise than as specifically described herein.

LIST OF DESIGNATIONS

1 Incineration furnace
2 Separator and filter stage
3 First screening stage
4 Wet deslagger
5 Second screening flap
6 Grinding stage
7 Melting furnace
8 Third screening stage
9 Optional classifying stage
10 Screw conveyor
11 Double flap valve
12 Burnt slag
13 Grate
14 Slag shaft
15 Deflection slab
16 Shaft
17,18 Walls of 16
19 Water level in 4
20,21 Collection hopper

What is claimed as new and desired to be secured by Letters Patent of the United States is:

1. A process for treating slag from refuse incineration plants in which the crude slag, after passing through a firing grate, is separated into at least two fractions directly and without previous quenching in a water bath and these two fractions are further processed separately, and first fraction, having a particle size up to 80 mm, is separated off in a first screening stage and a screen oversize of the first screening stage is fed to a location for wet deslagging, and wherein a screen undersize is fed to a second screening stage for separating off fine fraction having a particle size up to 2 mm, and further herein a screen oversize of the second screening stage is mechanically comminuted, and a screen undersize of the second screening stage is fed to for further treatment.

2. The process as claimed in claim 1, wherein the screen oversize of the second screening stage is fed after mechanical comminutation to a third screening stage and fine fraction having a particle size up to 2 mm of this third screening stage is fed to said location for further treatment together with the screen undersize produced in the second screening stage.

3. The process as claimed in claim 2, wherein a classifying stage is connected between the second and third screening stage in order to remove metals and other inert substances.

4. The process as recited in claim 3, wherein in said classifying stage, metals are separated into ferrous metals and non-ferrous metals.

5. The process as claimed in claim 2, wherein the first screening stage is one of: (a) integrated into the firing grate of the incineration furnace, and (b) connected directly to said firing grate.

6. The process as claimed in claim 2, wherein the screen undersize of the first screening stage is transported to the second screening stage by a discharge means which simultaneously acts as air exclusion means.

7. The process as claimed in claim 1, wherein the first screening stage is one of: (a) integrated into the firing grate of the incineration furnace, and (b) connected directly to said firing grate.

8. The process as claimed in claim 7, wherein a mesh travelling grate is used as the first screening stage and a vibrating screen is used as the second screening stage.

9. The process as claimed in claim 8, wherein the screen oversize of the first screening stage is fed directly to the wet deslagger.

10. The process as claimed in claim 8, wherein the screen undersize of the first screening stage is transported to the second screening stage by a discharge means which simultaneously acts as air exclusion means.

11. The process as claimed in claims 8, wherein a classifying stage is connected between the second and third screening stage in order to remove metals and other inert substances.

12. The process as claimed in claim 7, wherein the screen oversize of the first screening stage is fed directly to the wet deslagger.

13. The process as claimed in claim 12, wherein the screen undersize of the first screening stage is transported to the second screening stage by a discharge means which simultaneously acts as air exclusion means.

14. The process as claimed in claim 12, wherein a classifying stage is connected between the second and third screening stage in order to remove metals and other inert substances.

15. The process as claimed in claim 7, wherein the screen undersize of the first screening stage is transported to the second screening stage by a discharge means which simultaneously acts as air exclusion means.

16. The process as claimed in claim 7, wherein a classifying stage is connected between the second and third screening stage in order to remove metals other inert substances.

17. The process as claimed in claims 1, wherein the screen undersize of the first screening stage is transported to the second screening stage by a discharge means which simultaneously acts as air exclusion means.

18. The process as claimed in claim 17, wherein the material to be discharged is simultaneously cooled in the discharge element.

19. The process as claimed in claim 18, wherein the air exclusion is additionally effected by means of a double flap valve arrangement which is connected downstream of the discharge element.

20. The process as claimed in claim 17, wherein the air exclusion is additionally effected by means of a double flap valve arrangement which is connected downstream of the discharge element.

21. The process as claimed in claim 17, wherein a classifying sage is connected between the second and third screening stage in order to remove metals and other inner substances.

22. The process as recited in claim 1, further including feeding a material which passes through the firing grate to said second screening stage.

23. The process as recited in claim 1, wherein said first fraction separated off in said first screening stage comprises particles having a particle size up to 35 mm.

24. The process as recited in claim 1, wherein said further treatment includes a melting treatment of the screen undersize of the second screening stage in a melting furnace.

* * * * *